US011825942B2

(12) United States Patent
Hixson

(10) Patent No.: US 11,825,942 B2
(45) Date of Patent: Nov. 28, 2023

(54) COLLAPSIBLE PLATFORM ASSEMBLY

(71) Applicant: Perry Hixson, Pottstown, PA (US)

(72) Inventor: Perry Hixson, Pottstown, PA (US)

( * ) Notice: Subject to any disclaimer, the term of this patent is extended or adjusted under 35 U.S.C. 154(b) by 0 days.

(21) Appl. No.: 17/861,328

(22) Filed: Jul. 11, 2022

(65) Prior Publication Data

US 2023/0017385 A1 Jan. 19, 2023

Related U.S. Application Data

(60) Provisional application No. 63/220,748, filed on Jul. 12, 2021.

(51) Int. Cl.
*A47B 87/00* (2006.01)
*A47B 1/08* (2006.01)

(52) U.S. Cl.
CPC ..... *A47B 87/002* (2013.01); *A47B 1/08* (2013.01)

(58) Field of Classification Search
CPC ..... A47B 87/002; A47B 81/08; A47B 1/08
USPC ..... 108/116
See application file for complete search history.

(56) References Cited

U.S. PATENT DOCUMENTS 1,659,840 A * 2/1928 Smith ..... A47B 3/14 190/12 A
1,716,612 A * 6/1929 Wing ..... A47B 3/14 108/34
2,457,411 A * 12/1948 Steinberger ..... A47B 3/12 297/440.22
2,481,935 A * 9/1949 Larson ..... A47C 13/00 297/121
2,647,562 A * 8/1953 Hoffar ..... A47B 3/14 108/35
2,825,390 A * 3/1958 Post ..... A47B 3/14 297/440.22
2,991,829 A * 7/1961 Post ..... A47B 3/14 D6/337
3,994,527 A * 11/1976 Nikitits ..... A47B 3/14 D6/337
5,072,955 A 12/1991 Holland et al.
5,357,876 A 10/1994 Kniefel et al.
6,109,687 A * 8/2000 Nye ..... A47C 11/00 297/159.1
6,905,166 B2 * 6/2005 Zhurong ..... A47B 3/0912 108/132

(Continued)

*Primary Examiner* — Daniel J Troy
*Assistant Examiner* — Timothy M Ayres
(74) *Attorney, Agent, or Firm* — Boudwin Intellectual Property; Daniel Boudwin

(57) ABSTRACT

A collapsible platform assembly includes an upper platform having a perimeter wall, a top surface, and a plurality of pivoting support legs, and a lower platform having a perimeter wall, a top surface, and a plurality of pivoting support legs. A connector assembly connects the lower platform to the upper platform. The connector assembly is configured to provide adjustability of the collapsible platform assembly between a deployed configuration with the upper and lower platforms separated and a collapsed configuration with the top surface of the lower platform nesting within the perimeter wall of the upper platform. When deployed, the collapsible platform assembly provides two elevated platforms that can support a user to reach high areas. When collapsed, the platform assembly reduces in size with the lower platform nesting within the upper platform for compact storage and easy transport.

10 Claims, 2 Drawing Sheets

(56) References Cited

U.S. PATENT DOCUMENTS

| | | | | |
|---|---|---|---|---|
| 8,141,680 | B2 | 3/2012 | Wigutoff | |
| 8,596,598 | B2 * | 12/2013 | Lai | B25H 1/16 248/188.8 |
| 8,657,069 | B1 | 2/2014 | Schwengels | |
| 2013/0192925 | A1 | 8/2013 | Chitayat et al. | |

* cited by examiner

COLLAPSIBLE PLATFORM ASSEMBLY

CROSS REFERENCE TO RELATED APPLICATIONS

This application claims the benefit of U.S. Provisional Patent Application Ser. No. 63/220,748, filed on Jul. 12, 2022. The above identified patent application is herein incorporated by reference in its entirety to provide continuity of disclosure.

BACKGROUND OF THE INVENTION

The present invention relates to platforms, steps, supports, and the like. More specifically, the present invention provides a collapsible platform assembly that when deployed provides two elevated platforms that can support a user to reach high areas, and when collapsed reduces in size with the lower platform nesting within the upper platform for compact storage and easy transport.

Individuals that conduct work on their home or the home of their customers, can regularly find themselves performing tasks on ceilings, walls, and other elevated areas. In order to reach these areas, the individual must have some elevated object to stand on in order to effectively increase their height, allowing them to properly reach all the necessary areas and complete the desired tasks. One option is for the individual to utilize a ladder, which has multiple steps, or a stool, which has one step. However, traditional ladders and stools present limitations to the user. Specifically, if there is a wide area that the individual needs to access while completing some task, the user will regularly have to move and adjust the ladder or stool's position. The need to constantly move and adjust the traditional ladder or stool position will require the individual to climb up and down the ladder. Moreover, depending on the work that is being performed, the individual may need multiple tools to complete the task. This could lead to the individual constantly having to retrieve the necessary tools that they were unable to initially carry up the traditional ladder or stool. In doing so, the individual is increasing their risk of potential injury.

Another drawback to step ladders is that they often are bulky and even when folded to a non-use position still take up large amounts of space and are difficult to transport. Further, step ladders typically only have a very small profile and a small area for the user to step on. This means the user cannot adjust their position and can reach fewer areas. Further, the smaller steps of the step ladder can be more difficult to stand and balance on, which can potentially lead to accidental injury if the user slips and falls. Additionally, the climbing up and down a ladder to either adjust it or to retrieve an additional tool can be frustrating, tiring, and time consuming. In order to address the above concerns, the present invention provides users with a two-step platform system designed that provides a larger, bilevel support area when in use, and that can collapse to a compact position for storage and transport.

In light of the platform systems disclosed in the known art, it is submitted that the present invention substantially diverges in design elements from the prior art and consequently it is clear that there is a need in the art for an improvement to existing platforms, steps, supports, and the like. In this regard the present invention substantially fulfills these needs.

SUMMARY OF THE INVENTION

In view of the foregoing disadvantages inherent in the known types of step ladders and stools now present in the prior art, the present invention provides a collapsible platform assembly, wherein the same can be utilized for providing convenience for the user when accessing difficult to reach, high-up areas for various tasks.

The collapsible platform assembly generally includes an upper platform comprising a perimeter wall, a top surface, and a plurality of pivoting support legs, and a lower platform comprising a perimeter wall, a top surface, and a plurality of pivoting support legs. The lower platform is smaller than the upper platform, allowing the lower platform to nest within the upper platform when the assembly is collapsed. A connector assembly connects the lower platform to the upper platform via multiple pivotally connected supporting members. The connector assembly is configured to provide adjustability of the collapsible platform assembly between a deployed configuration with the upper and lower platforms separated and a collapsed configuration with the top surface of the lower platform nesting within the perimeter wall of the upper platform. In this way, the collapsible platform assembly can be deployed to provide a wider and safer support area, and collapsed for compact storage and easy transport via an attached carry handle.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
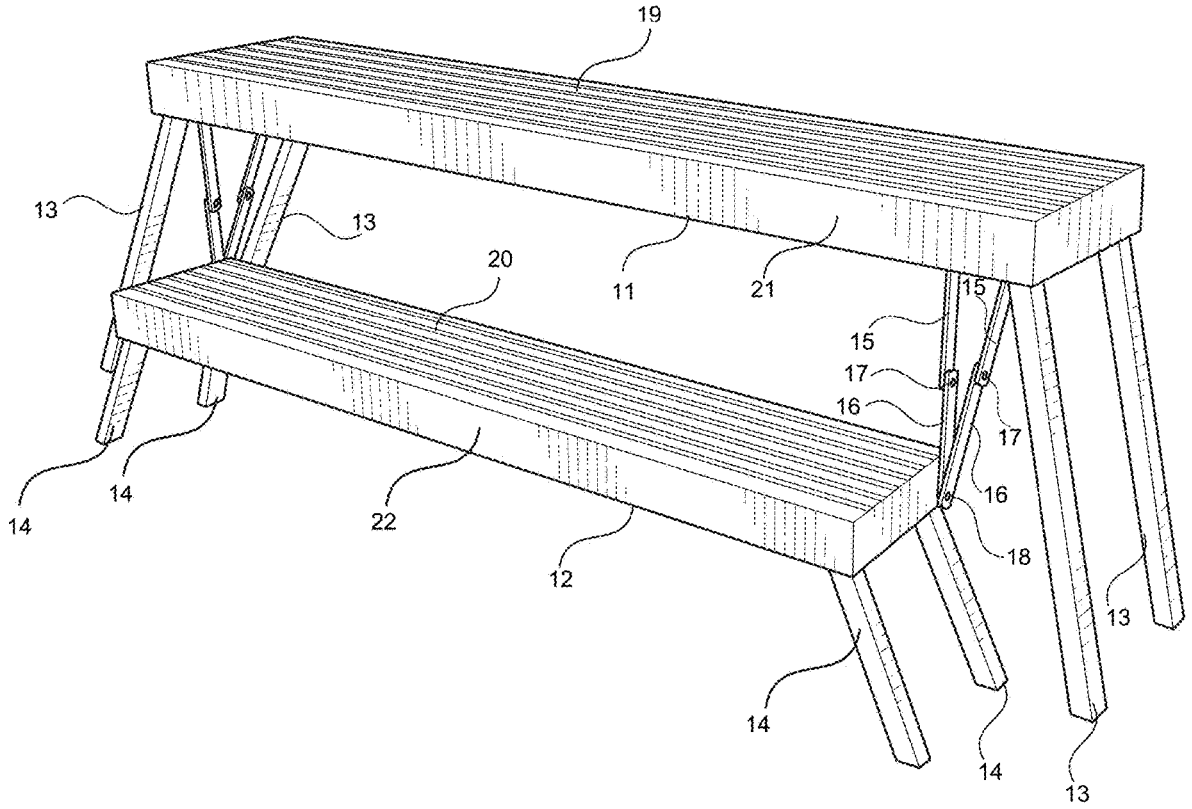
FIG. 1 shows an upper perspective view of an embodiment of the collapsible platform assembly in the deployed configuration.

Reference is made herein to the attached drawings. Like reference numerals are used throughout the drawings to depict like or similar elements of the collapsible platform assembly. For the purposes of presenting a brief and clear description of the present invention, the preferred embodiment will be discussed as used for providing a platform assembly that can be deployed to provide a wider and safer support area, and collapsed for compact storage and easy transport via an attached carry handle. The figures are intended for representative purposes only and should not be considered to be limiting in any respect.

Referring now to FIG. 1, there is shown an upper perspective view of an embodiment of the collapsible platform assembly in the deployed configuration. The collapsible platform assembly includes an upper platform 11 comprising a perimeter wall 21, a top surface 19, and a plurality of pivoting support legs 13. Connected to the upper platform 11 is a lower platform 12 comprising a perimeter wall 22, a top surface 20, and a plurality of pivoting support legs 14. In the shown embodiment, each top surface 19, 20 includes a textured element for improved grip and safety. The plurality of pivoting support legs 14 of the lower platform 12 may be linear vertical shaped or the like.

Figure 2:
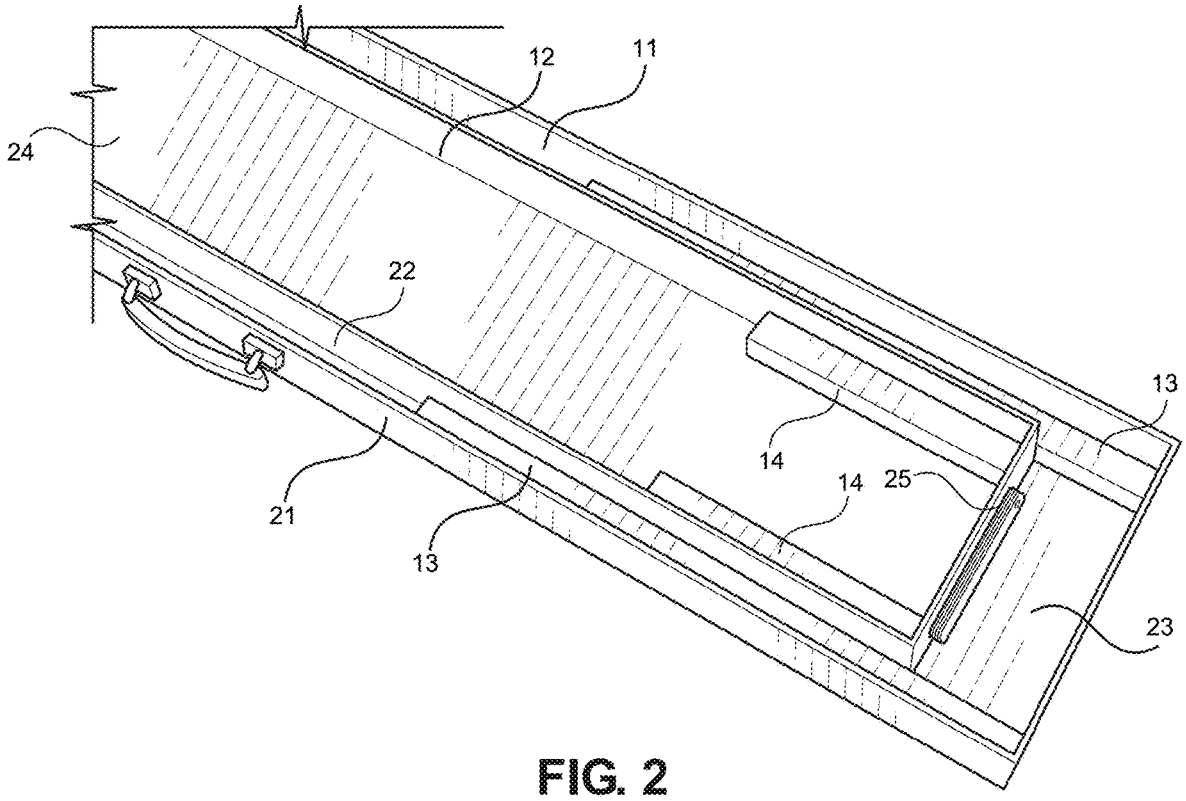
FIG. 2 shows a lower perspective view of an embodiment of the collapsible platform assembly in the collapsed configuration.
Figure 3:
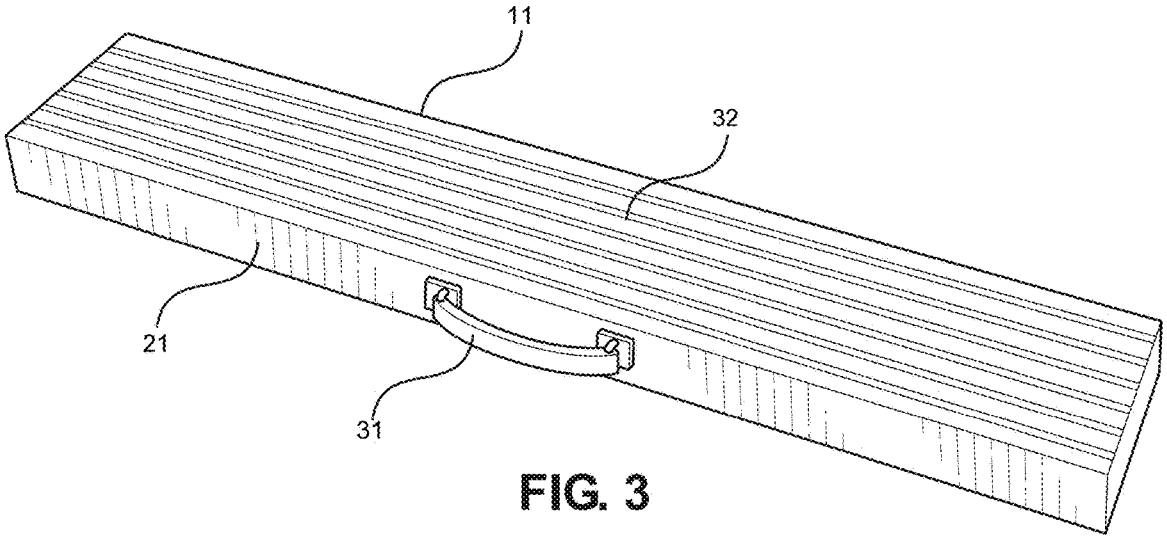
FIG. 3 shows an upper perspective view of an embodiment of the collapsible platform assembly in the collapsed configuration.

The upper platform 11 is connected to the lower platform 12 via a connector assembly. The connector assembly is configured to provide adjustability of the collapsible platform assembly between a deployed configuration with the upper and lower platforms separated, as illustrated in FIG. 1, and a collapsed configuration with the top surface of the lower platform nesting within the perimeter wall of the upper platform, as illustrated in FIGS. 2 and 3. The connector assembly includes a pair of upper connectors 15 each having an upper end pivotally connected to the upper platform 19 and a pair of lower connectors 16 each having a first end pivotally connected to a lower end of each upper connector 15. A lower end of each lower connector 16 is pivotally connected to the lower platform 12. Further, the upper and lower support legs 13, 14 are pivotally connected to their respective upper and lower platforms 11, 12. The pivoting connection points of the support legs 13, 14 further allow the assembly to move between collapsed and deployed configurations. Each of the support legs 13 of the upper platform 11 includes a length that is greater than a length of each of the support legs 14 of the lower platform 12, providing the two-level deployed configuration of the assembly.

In the shown embodiment, the lower ends of the lower connectors 16 are pivotally connected to the outer side of the perimeter wall 22 of the lower platform 12. This positioning makes it easier for the lower platform 12 to nest within the upper platform 11 when the assembly is collapsed. Additionally, the upper platform support legs 13 and lower platform support legs 14 extend outwardly at an angle from the upper and lower platforms 11, 12 when the platform assembly is in the deployed position. This provides a more stable support for the deployed assembly, and further maintains that the upper and lower support legs 13, 14 do not interfere with one another when the assembly is in the process of being collapsed or deployed.

Referring now to FIG. 2, there is shown an upper perspective view of an embodiment of the collapsible platform assembly in the collapsed configuration. The lower platform 12 includes a width and a length that are both less than a width and a length of the upper platform 11, which allows for nesting of the lower platform 12 within the upper platform 11, such that the lower platform 12 is entirely contained within the area defined by the perimeter wall 21 of the upper platform. The lower platform 12 nests between the support legs 13 of the upper platform 11 when the connector assembly is in the full collapsed position.

In the shown embodiment, the upper legs 13 abut the upper platform perimeter wall 21 on one side and the lower platform perimeter wall 22 on an opposing side when the connector assembly 25 is in the fully collapsed position. This helps provide friction to maintain the collapsed position of the components of the present invention. In other embodiments, the assembly can have different fasteners, such as clips, straps, or the like, for securing the assembly in its collapsed position. Further, in the shown embodiment, the lower platform legs 14 each include one side that lays flush against an interior side 24 of the lower platform top surface 20 when the connector assembly 25 is in the fully collapsed position. Similarly, the upper platform legs 13 each include one side that lays flush against an interior side 23 of the upper platform top surface 19 when the connector assembly is in the fully collapsed position. This provides a more compact folded size for the assembly when in the collapsed configuration.

Referring now to FIG. 3, there is shown a lower perspective view of an embodiment of the collapsible platform assembly in the collapsed configuration. In the shown embodiment, the collapsible platform assembly includes a carry handle 31 to facilitate easy transport of the assembly when not in use and in the collapsed position. Further, in the shown embodiment, the carrying handle is affixed to the perimeter wall 21 of the upper platform 11, such that the handle 31 includes a pair of opposing ends each adjustably connected to the perimeter wall 21 of the upper platform 11. This allows the center of mass to adjust with gravity as the user carries the collapsed assembly, making it much easier and more comfortable to transport. The textured upper surface elements 32 also allows the upper platform 11 to support various items thereon when the assembly is in the collapsed position. In this way, the assembly is easy to store and transport while providing additional utility when in the collapsed configuration.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible platform assembly, comprising:

an upper platform comprising a perimeter wall, a top surface, and a plurality of pivoting support legs;

a lower platform comprising a perimeter wall, a top surface, and a plurality of pivoting support legs;

a connector assembly connecting the lower platform to the upper platform;

wherein the connector assembly is configured to provide adjustability of the collapsible platform assembly between a deployed configuration with the upper and lower platforms separated and a collapsed configuration with the top surface of the lower platform nesting within the perimeter wall of the upper platform;

the plurality of pivoting support legs are linear vertical shaped;

wherein the upper platform top surface and the lower platform top surface include textured elements for improved grip;

wherein the connector assembly comprises a pair of upper connectors each having an upper end pivotally connected to the upper platform and a pair of lower connectors each having a first end pivotally connected to a lower end of each upper connector, wherein a lower end of each lower connector is pivotally connected to the lower platform; and wherein the lower ends of the lower connectors are pivotally connected to the perimeter wall of the lower platform;

wherein the lower platform nests between the support legs of the upper platform when the connector assembly is in the full collapsed position; and further comprising one or more straps configured to secure the assembly in the fully collapsed position.

2. The collapsible platform assembly of claim 1, wherein the upper platform support legs and lower platform support legs extend outwardly at an angle from the upper and lower platforms when the platform assembly is in the deployed position.

3. The collapsible platform assembly of claim 1, further comprising a carrying handle.

4. The collapsible platform assembly of claim 3, wherein the carrying handle is affixed to the perimeter wall of the upper platform.

5. The collapsible platform assembly of claim 4, wherein the handle includes a pair of opposing ends each adjustably connected to the perimeter wall of the upper platform.

6. The collapsible platform assembly of claim 1, wherein the upper legs abut the upper platform perimeter wall on one side and the lower platform perimeter wall on an opposing side when the connector assembly is in the fully collapsed position.

7. The collapsible platform assembly of claim 1, wherein the lower platform legs each include one side that lays flush against an interior side of the lower platform top surface when the connector assembly is in the fully collapsed position.

8. The collapsible platform assembly of claim 1, wherein the upper platform legs each include one side that lays flush against an interior side of the upper platform top surface when the connector assembly is in the fully collapsed position.

9. The collapsible platform assembly of claim 1, wherein the lower platform includes a width and a length that are both less than a width and a length of the upper platform.

10. The collapsible platform assembly of claim 1, wherein each of the support legs of the upper platform includes a length that is greater than a length of each of the support legs of the lower platform.

* * * * *